US005347243A

United States Patent [19]

Kich et al.

[11] Patent Number: 5,347,243

[45] Date of Patent: Sep. 13, 1994

[54] NON-CONTACTING WAVEGUIDE "T" SWITCH

[75] Inventors: Rolf Kich, Redondo Beach; Omar M. Al-Bundak, Los Angeles, both of Calif.

[73] Assignee: Hughes Aircraft Company, Los Angeles, Calif.

[21] Appl. No.: 995,482

[22] Filed: Dec. 23, 1992

[51] Int. Cl.[5] ..... H01P 1/10; H01P 5/12

[52] U.S. Cl. ..... 333/106; 333/107; 333/108; 333/258

[58] Field of Search ..... 333/106, 107, 108, 258

[56] References Cited

U.S. PATENT DOCUMENTS 4,242,652 12/1980 Shishido et al. ..... 333/106
4,920,324 4/1990 Whittaker et al. ..... 333/106
4,945,320 7/1990 Hettlago ..... 333/106

FOREIGN PATENT DOCUMENTS 0158836 12/1979 Japan .

*Primary Examiner*—Benny Lee
*Assistant Examiner*—Darius Gambino
*Attorney, Agent, or Firm*—William J. Streeter; Wanda K. Denson-Low

[57] ABSTRACT

A non-contacting waveguide "T" switch (10) is provided including a stator (12), a rotor (14) mounted for rotation relative to the stator, and a coaxial conductor (64) located at the axis of the rotor for carrying a coaxial transmission. The stator (12) has at least one waveguide port (32). The rotor (14) includes a through-waveguide (48) and an impedance matching transformer (52) disposed in the through-waveguide (48) for converting the coaxial transmission into a waveguide transmission. The transformer (52) has a bore which forms a non-contacting sleeve about the coaxial conductor (64). The through-waveguide (48) carries the waveguide transmission radiated from the transformer to the at least one waveguide port (32).

27 Claims, 8 Drawing Sheets

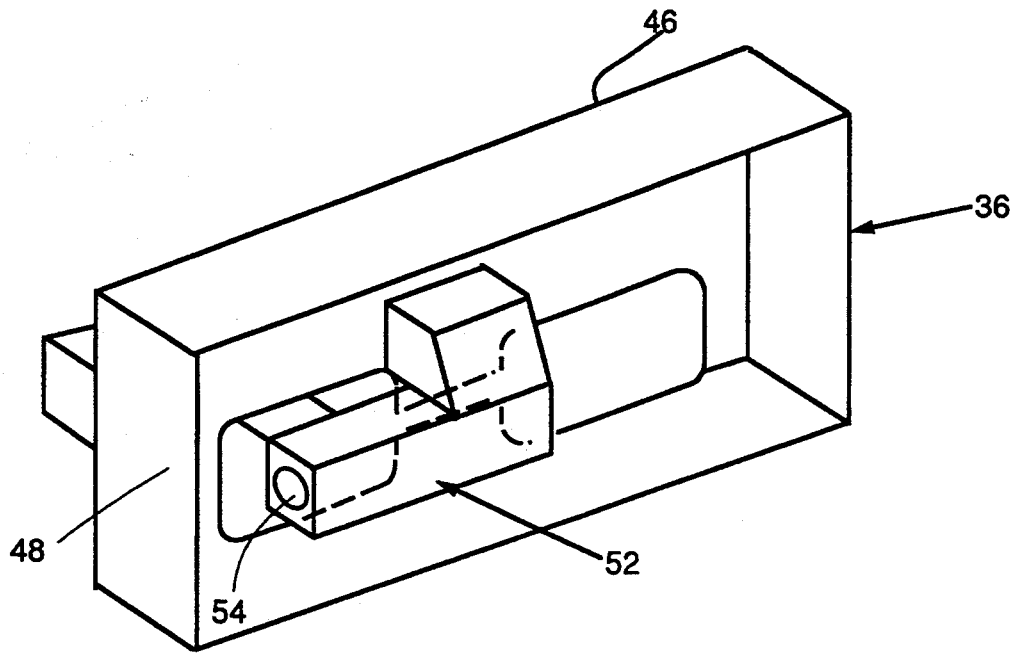
FIG. 6.
FIG. 7.
| SWITCH DIAGRAM | SWITCH STATE | PORT CONNECTION |
|---|---|---|
| 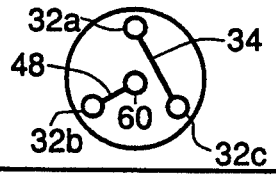  | 1 | 60-32b<br>32a-32c |
| 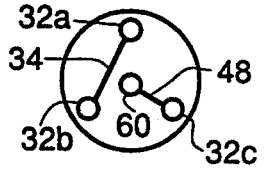  | 2 | 60-32c<br>32a-32b |
| 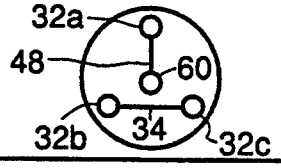  | 3 | 60-32<br>32b-32c |

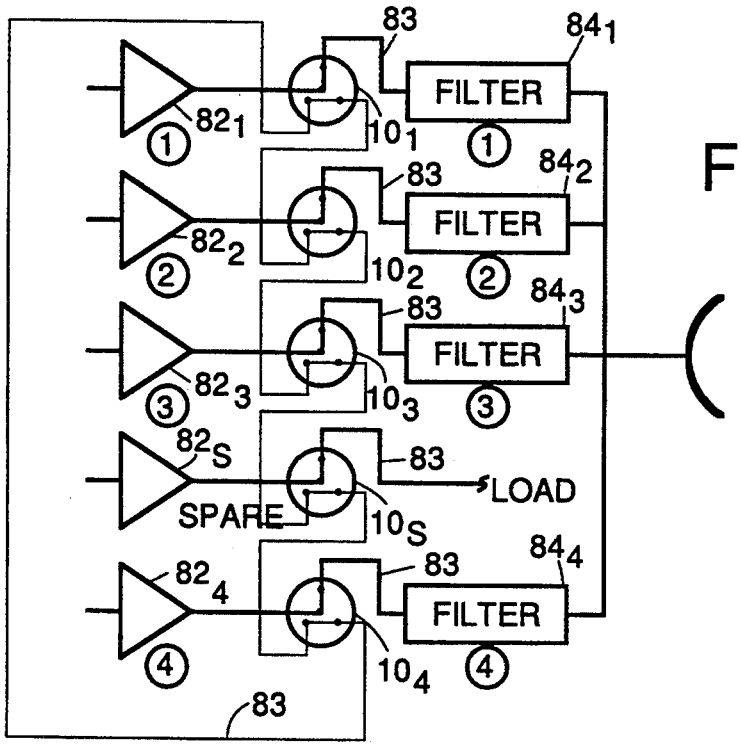
FIG. 8.
FIG. 9.
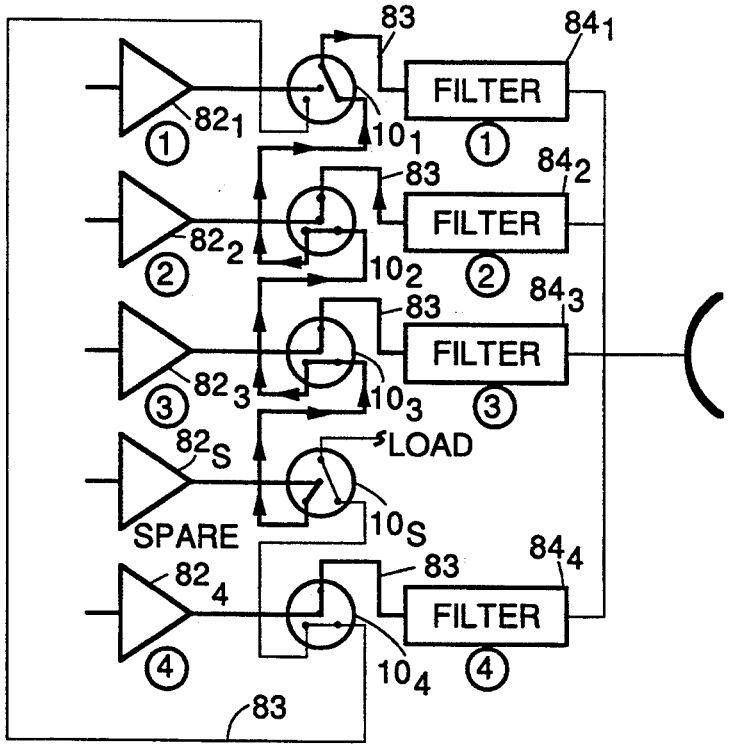

NON-CONTACTING WAVEGUIDE "T" SWITCH

TECHNICAL FIELD

The invention relates to waveguide switches and, more particularly, to a non-contacting waveguide "T" switch.

BACKGROUND ART

Waveguide switches for use in satellite communication systems are well known in the art. Typically, waveguide switches include a plurality of waveguide paths through which signals are routed, imparting to the switches the capability to provide redundant paths should a communication element, such as an amplifier, fail. Several waveguide switch designs exist, such as "C", "S" and "R" switches, to name a few. The different types of switches usually have waveguide paths differing not only in number, but in geometry.

For example, U.S. Pat. No. 4,945,320, issued to Hettlage et al., discloses a microwave switch having at least two switching positions. The microwave switch has at least one rectangular waveguide passage and a rotor of the switch selectively connectable with waveguide sections and a housing of the switch. A relatively wide transmission bandwidth with good transmission characteristics is realized, due to the waveguide passages provided in the switch. At least two different switching positions are available for the selective connection of at least one coaxial input line with at least one of two output lines of which at least one is a coaxial line.

It is desirable, however, to have a non-contacting waveguide "T" switch. Since non-contacting switches have fewer moving parts and no contact resistances to create problems, non-contacting switches are extremely reliable and are capable of hot switching.

SUMMARY OF THE INVENTION

It is an object of the present invention to provide a non-contacting waveguide "T" switch for reliably switching coaxial or waveguide transmissions.

It is a further object of the present invention to provide a non-contacting waveguide "T" switch with double-ridged waveguides.

It is yet a further object of the present invention to provide a non-contacting waveguide "T" switch having a coaxial conductor located at the axis of the rotor of the switch.

In carrying out the above object and other objects and features of the present invention, a waveguide "T" switch is provided comprising a stator having at least one waveguide port and a coaxial conductor for carrying a coaxial transmission, the coaxial conductor being affixed to the stator. The waveguide "T" switch also comprises a rotor mounted for rotation relative to the stator. The rotor includes a first waveguide and a single impedance matching transformer disposed in the waveguide for converting the coaxial transmission into a waveguide transmission. The transformer has a bore which forms a non-contacting sleeve about the coaxial conductor and the first waveguide carries the waveguide transmission radiated from the transformer to the at least one waveguide port.

In its preferred construction, the first waveguide is a double-ridged waveguide and is generally orthogonal to the conductor, which is located on the axis of the rotor. The rotor further comprises a second double-ridged waveguide extending therethrough to selectively connect two waveguide ports in the stator.

The advantages accruing to the non-contacting waveguide "T" switch of the present invention are numerous. For example, since there are fewer moving parts and no contact resistances, the non-contacting waveguide "T" switch is extremely reliable and allows for hot switching without a decrease in RF power. Additionally, since double-ridged waveguides are utilized, a reduction in volume from the standard switch height is realized, resulting in very small switch package.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 6 is a perspective view of the coax-to-ridge waveguide transformer for use with the waveguide "T" switch shown in FIG. 1;

FIG. 7 is a table illustrating the switch diagram, switch state, and associated port connections for the waveguide "T" switch of the present invention;

FIG. 8 is a schematic representation of a switching system in normal operation employing the waveguide "T" switch of the present invention;

FIG. 9 is a schematic representation of the switching system shown in FIG. 8 after redundancy switching has occurred to compensate for a failed circuit element;

BEST MODE FOR CARRYING OUT THE INVENTION

Figure 1:
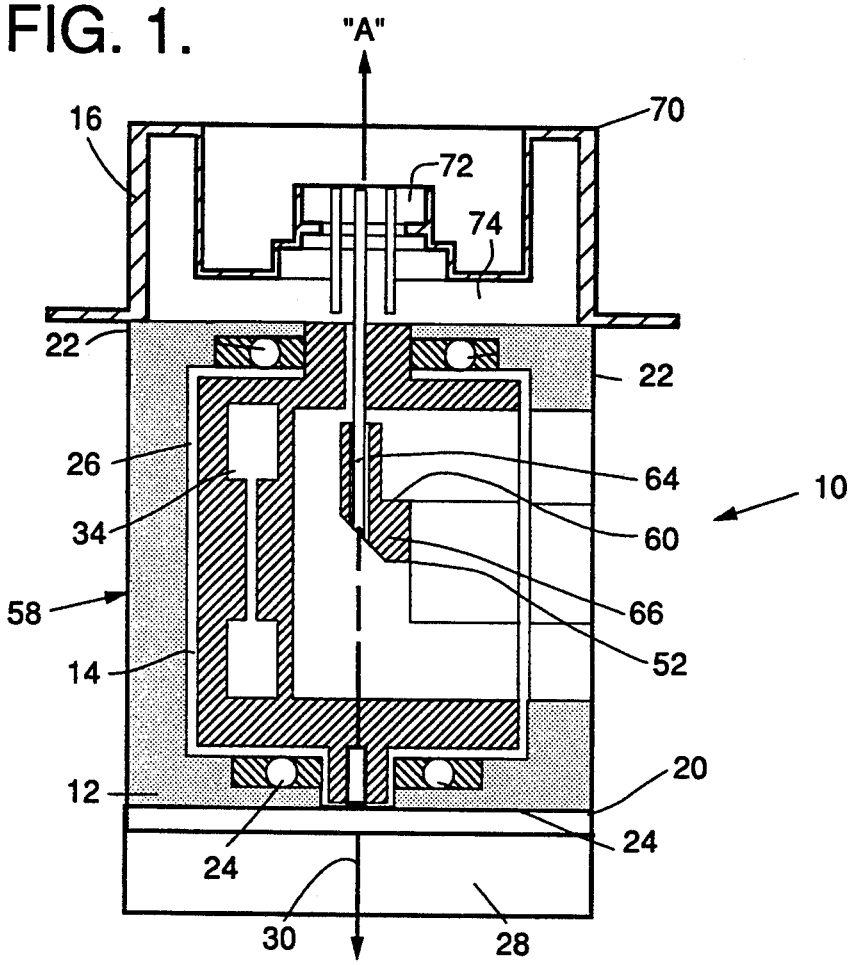
FIG. 1 is a cross-sectional view of the non-contacting "T" waveguide switch of the present invention.

Referring to FIG. 1 of the drawings, there is shown a non-contacting waveguide "T" switch shown generally by reference numeral 10. The waveguide switch 10 is preferably suitable for applications involving signals having a frequency approximately in the C band (i.e., 3.6–4.2 GHz). Although the switch illustrated is useful for applications involving the C band, similar switches for use with other frequency bands could be implemented. As illustrated, the switch 10 includes a housing, or stator, 12 and a rotor 14 disposed within the stator. A top cover 16 is affixed to one end of the stator by a plurality of screws (not specifically illustrated) or the like and a bottom cover 20 is affixed to the opposite end of the stator 12.

As best shown in FIG. 1, bearings 22 and 24 are positioned between the stator 12 and the rotor 14 to allow the rotor to rotate relative to the stator. The rotor 14 is preferably sized such that an air gap 26 exists between the stator 12 and the rotor. An actuator, such as a motor 28, having a drive shaft 30, cooperates with the switch 10 such that the drive shaft extends into and engages the rotor 14 for rotation about an axis A relative to the stator 12.

Figure 2:
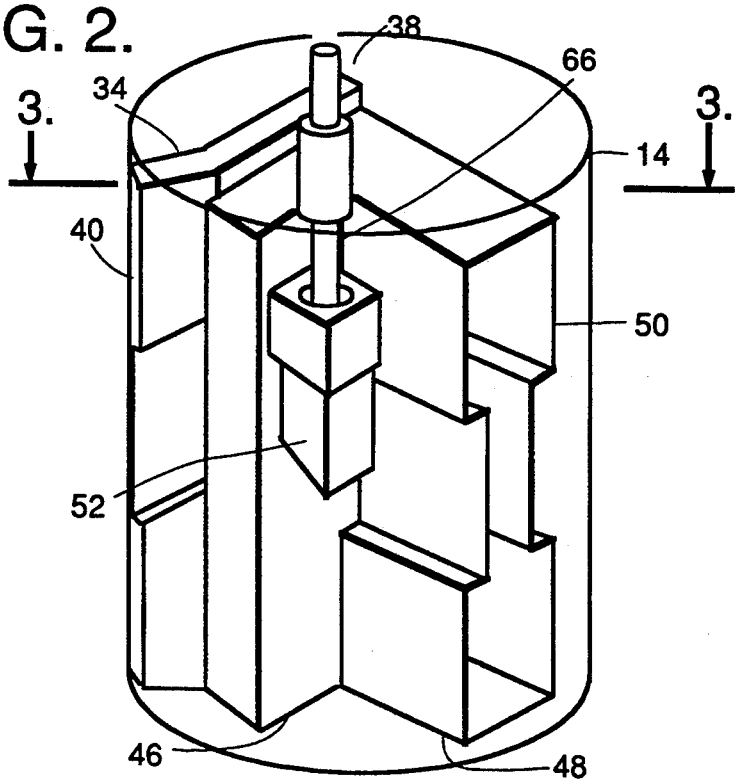
FIG. 2 is an isometric view of the rotor of the waveguide "T" switch shown in FIG. 1.
Figure 3:
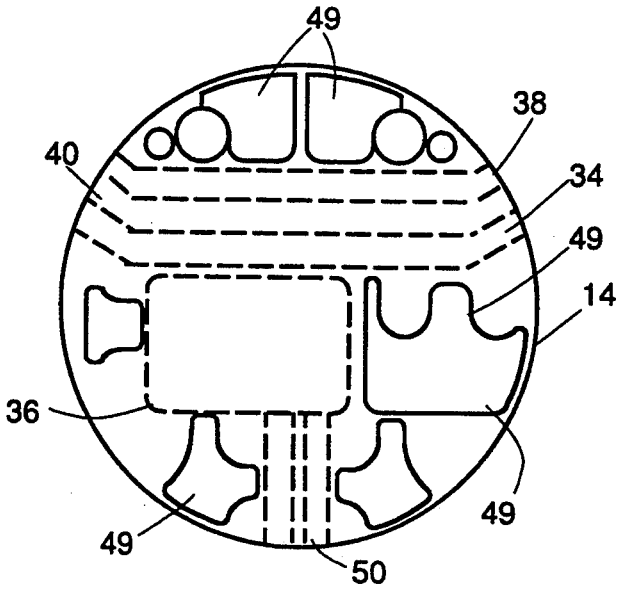
FIG. 3 is a plan view of the rotor shown in FIG. 2 taken along line 3—3.
Figure 4:
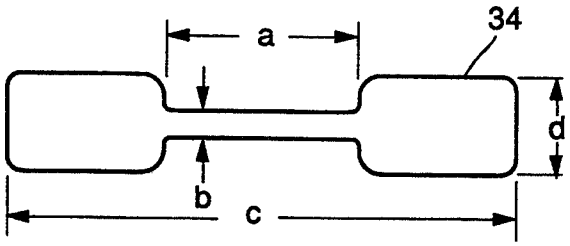
FIG. 4 is a cross-sectional view of a double-ridged waveguide for use in the waveguide "T" switch of the present invention.

With additional reference to FIGS. 2 through 4, the rotor 14 is generally cylindrically shaped and includes a waveguide path 34 and a coax-to-waveguide adaptor 36. As illustrated, the waveguide path 34 is generally curved in shape and extends through the rotor 14 to form a pair of waveguide path ports 38 and 40 at the rotor perimeter.

As best shown in FIG. 4, to achieve minimum switch package size without dielectric loading, the waveguide path 34 is preferably a double-ridged waveguide, resulting in a generally dumbbell-shaped waveguide path and associated path ports 38 and 40. Preferably, the double-ridged waveguide has the following dimensions: $a \approx 0.400''$, $b \approx 0.054''$, $c \approx 1.214''$ and $d \approx 0.188''$. The path ports 38 and 40 are angularly disposed about the circumference of the rotor 14 approximately 120° from each other, thereby connecting different pairs of the stator waveguide ports 32*a–c* (shown in FIG. 5) upon rotation of the rotor, as described in greater detail below. As best shown in FIG. 3, the rotor 14 includes a plurality of voids 49. The voids 49 reduce the overall weight and inertia of the rotor 14, thereby allowing the rotor to be rotated to a desired position quicker.

Figure 5:
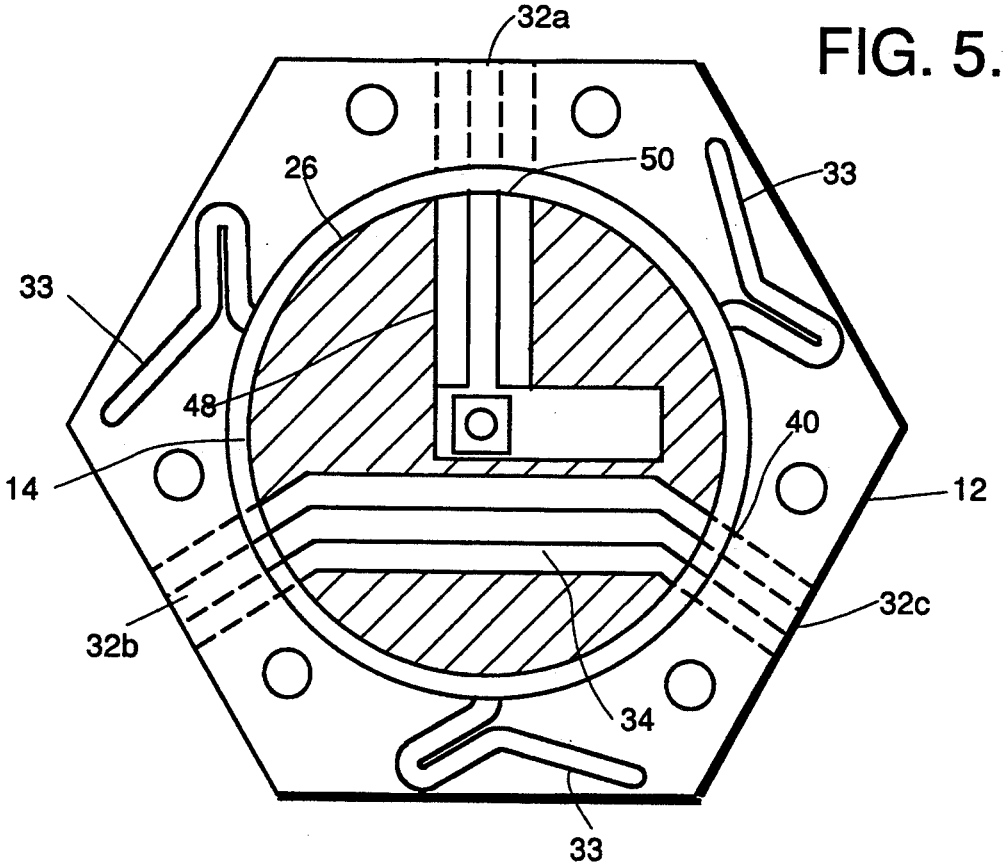
FIG. 5 is a plan view of the stator and rotor assembly of the waveguide "T" switch as shown in FIG. 1.

With additional reference to FIG. 5, it can be seen that the stator 12 is multi-faceted and includes three waveguide ports 32*a–*32*c* angularly spaced from each other by approximately 120°. The stator 12 includes three passages 33 having an approximate width of 0.060". The passages 33 function as RF chokes to isolate the waveguide ports 32*a–c* from each other by representing an electrical short circuit between adjacent ports, resulting in less leakage. In the preferred embodiment, the waveguide ports 32 are double-ridged waveguide ports and extend from the perimeter of the stator inwardly to the air gap 26 generally orthogonal to the axis A.

With continuing reference to FIGS. 2 through 4, the coax-to-waveguide adaptor 36 is preferably an L-shaped cavity having a shorted-waveguide 46 and a through-waveguide 48. The shorted-waveguide 46 extends radially outward from the rotor axis A terminating short of the rotor perimeter, while the through-waveguide 48 extends radially outwardly from the axis A and terminates at the rotor perimeter to form an associated waveguide port 50. Preferably, the through-waveguide 48 is double-ridged. As shown in FIG. 5, when the waveguide ports 38 and 40 are aligned with waveguide ports 32*b* and 32*c*, the through-waveguide 48 and associated waveguide port 50 are aligned with the waveguide port 32*a*.

With combined reference to FIGS. 1, 2 and 6, the coax-to-waveguide adaptor 36 includes an aluminum coax-to-waveguide transformer 52. In the preferred embodiment, the coax-to-waveguide transformer 52 is a ¼-wave transformer and is affixed to the upper ridge of the through-waveguide 48. The coax-to-waveguide transformer functions to transfer the 50Ω coax impedance to that of the double-ridged waveguide impedance. The adaptor 36 and coax-to-waveguide transformer 52 preferably comprise a single machined part and the transformer 52 includes an axial bore 54 generally aligned with the axis A of the rotor 14. In prior art coax-to-waveguide adaptors, the free end of the center conductor is typically soldered to the transformer. In the switch of the present invention, however, the free end 66 of the center conductor 64 is not soldered to the transformer 52. Thus, the bore 54 and the center conductor 64 cooperate to provide a low, open-end impedance that transforms to an electrical short at the center conductor 64, allowing the rotor 14 to rotate around it's axis.

Referring again to FIG. 1, the switch 10 includes a housing 58 which receives a standard coax connector (not specifically illustrated). The coax connector includes a center conductor 64 which extends through the top cover 16 into the rotor 14 along the axis A. Preferably, the center conductor 64 extends into the axial bore 54 of the transformer 52, which is sized to receive the conductor 64 in a non-contacting fashion so as to create a non-contacting capacitive sleeve, or coaxial port 60, over the coax center conductor 64. This construction allows for hot switching without a corresponding decrease in the RF power. Most preferably, the center conductor 64 is Teflon loaded so as to decrease the size of the overlapping capacitive length. The non-contacting construction also forms a first choke joint for the switch 10, which provides a virtual short at the interface of the center conductor 64 and the transformer 52. As best shown in FIG. 6, the transformer 52 most preferably includes a 90° step, or folded section, creating an associated angled reflector surface 53. This construction allows the coax conductor 64 to be impedance matched to the through-waveguide 48.

The center conductor 64 carries a coaxial transmission, which is received by the transformer 52 as a radiated electromagnetic signal at the free end 66 of the conductor 64. The signal is then reflected by the reflector surface 53 as the transformer 52 transforms the coaxial transmission to an associated waveguide transmission, which is carried by the through-waveguide 48. Thus, the transformer 52 matches the impedance of the coaxial conductor (approximately 50 Ω) with the impedance of a through-waveguide (approximately 377 Ω).

With continuing reference to FIG. 1, the top cover, or outer conductor, 16 forms a second choke joint 70 for the switch 10. Preferably, the choke joint 70 includes a low impedance section shown generally by reference numeral 72 in communication with a high impedance section shown generally by reference numeral 74. As illustrated, the low impedance section 72 of the radial choke joint 70 has approximately a 0.010" air gap and is folded three times about the center conductor 64 within the outer diameter of the rotor bearing shaft 23 to obtain an electrical length of approximately ¼ wavelength. The high impedance section 74 of the radial choke joint 70 is also folded to obtain an electrical length of approximately ¼ wavelength within the external stator diameter. As illustrated, this construction locates the bearing 22, a poor metal-to-metal contact, at the open circuit junction of the choke 70. This RF choke construction allows the outer conductor to provide a continuous electrical outer conductor while maintaining a physically non-contacting outer conductor.

Referring now to FIG. 7, a table illustrates the switch diagram, switch state and associated waveguide port connections for the "T" switch of the present invention. When the rotor 14 is positioned in switch state 1, the coaxial transmission carried on the center conductor 64 of the coax port 60 is transformed into an associated waveguide signal for transmission through the through-waveguide 48 to the stator waveguide port 32*b*. The waveguide path 34, which extends between the waveguide ports 38 and 40, connects the remaining pair of stator waveguide ports 32*a* and 32*c*.

Upon rotation of the rotor 14 through a counterclockwise angular displacement of 120°, the switch 10 is in switch state "2". As illustrated with reference to switch state "2" the through-waveguide 48 connects the coax port 60 to the stator waveguide port 32*c*. The waveguide 34 connects stator waveguide ports 32*a* and 32*b*. Upon further counterclockwise rotation of the rotor 14 through an angle of 120°, the switch is in switch state "3" wherein the through-waveguide 48 connects the coax port 60 to the stator waveguide port 32*a* and the waveguide 34 connects the stator waveguide ports 32*b* and 32*c*. Of course, the rotor can be rotated in a clockwise direction so that any switch state can be achieved with a single 120° rotation of the rotor 14.

Referring now to FIGS. 8 and 9, there is shown a schematic representation of a communication system employing the "T" switch of the present invention. The communication system shown comprises four (4) subsystems labeled 1–4, each subsystem including an amplifier $82_{1\text{-}4}$, a "T" switch $10_{1\text{-}4}$ and a filter $84_{1\text{-}4}$. The switches and filters are interconnected by waveguide flanges 83, which can be affixed to any stator port. The system also includes at least one spare amplifier $82_s$ and a spare "T" switch $10_s$, which function to provide a redundancy capability to the communication system, as described in greater detail below. For the sake of clarity, reference numerals identifying the individual waveguides and waveguide ports associated with the switches $10_{1\text{-}4}$ have been omitted.

During normal operation, as shown in FIG. 8, each "T" switch $10_{1\text{-}4}$ routes a coaxial transmission from the amplifier $82_{1\text{-}4}$ through an associated switch $10_{1\text{-}4}$ to the associated filter $84_{1\text{-}4}$. As illustrated, the switches $10_1$ through $10_4$ are interconnected by waveguide flanges 83 via their respective waveguide paths 34. Although the "T" switches are shown in switch state "3", any other switch state could be employed during normal operation.

Referring now to FIG. 9, the communication system is shown after redundancy switching has occurred to compensate for the failed amplifier $82_1$. As shown, to utilize the spare amplifier $82_s$ and compensate for the failed amplifier $82_1$, "T" switch $10_1$ and "T" switch $10_s$ are preferably rotated through an angular displacement of 120° to switch state 1 shown in FIG. 5. After redundancy switching, the spare amplifier $82_s$ provides a coaxial transmission to the center conductor 64 of the coax connector of the switch $10_s$. This signal is transformed to a waveguide signal and transmitted through the broad wall waveguide path to the waveguide port. This waveguide signal is then routed through the "T" switches $10_3$, $10_2$ and $10_1$ to the filter $84_1$. Thus, by rotating "T" switches $10_1$ and $10_s$ to switch state "1", the failed amplifier $82_1$ can be replaced without interruption to other communication system elements. Although shown in FIG. 7 to replace a failed amplifier $82_1$, spare amplifier $82_s$ could replace any of the amplifiers $82_1$ through $82_4$.

Figure 10:
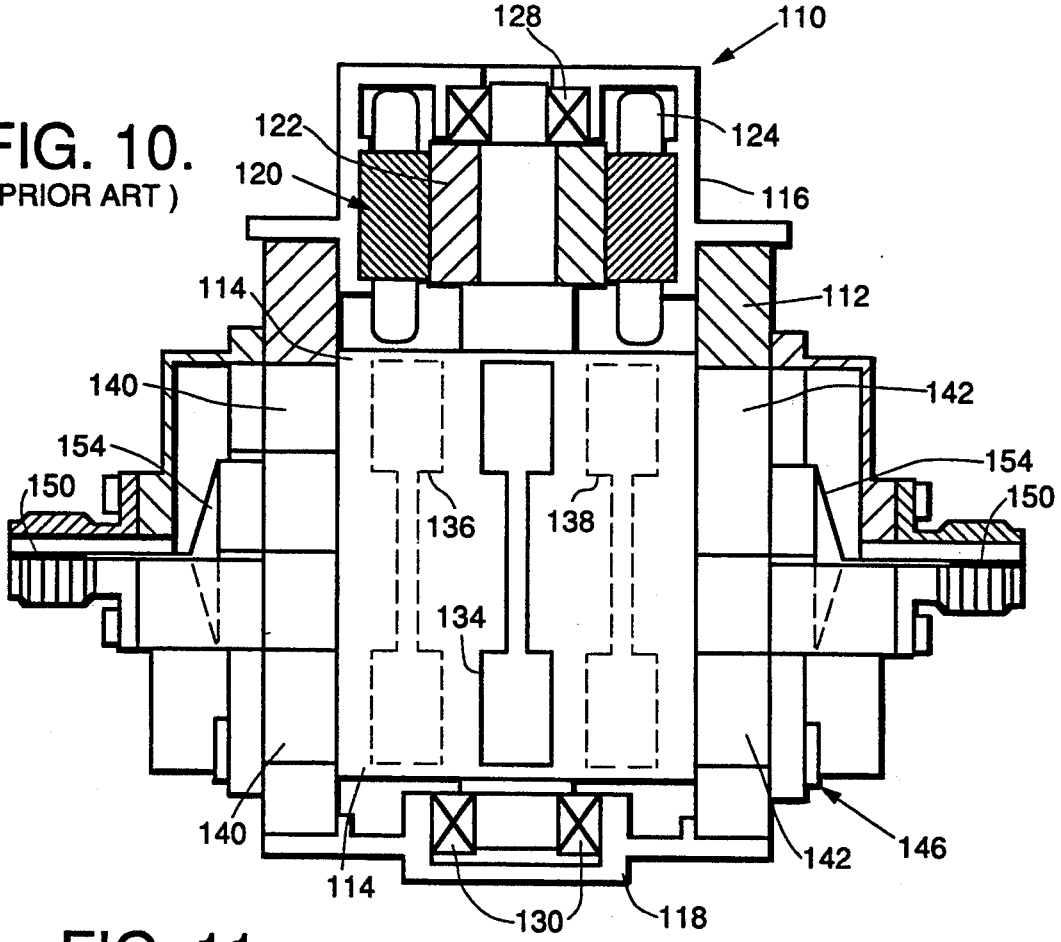
FIG. 10. ( PRIOR ART )
FIG. 10 is a cross-sectional view of a prior art non-contacting waveguide "R" switch.

Referring now to FIG. 10, there is illustrated a prior art non-contacting waveguide "R" switch shown generally by reference numeral 110, which is preferably suitable for applications involving signals having a frequency approximately in the C band (i.e., 3.6–4.2 GHz). As illustrated, the switch 110 includes a housing, or stator, 112 and a rotor 114 disposed within the stator 112 for rotation relative thereto. A top cover 116 is affixed to one end of the stator 112 and a bottom cover 118 is affixed to the opposite end of the stator. In the preferred embodiment, a motor 120 is disposed within the top cover 116. The motor includes a permanent magnet 122, stator coils 124 and a rotor shaft 126, which engages the rotor 114 for rotation relative to the stator 112. Bearings 128 and 130 allow rotation of the rotor shaft 126 and rotor 112, respectively.

As best shown in FIG. 10, the switch 110 includes a plurality of double-ridged waveguide paths indicated generally by the reference numerals 134, 136 and 138. Preferably, the waveguide path 134 generally bisects the rotor 114, and the second and third waveguide paths 136 and 138 are curved in shape. Each waveguide path terminates at the rotor perimeter so as to create a waveguide path port. Depending upon the position of the rotor 114, these waveguide path ports are aligned with waveguide ports of the stator 112, only two of which are shown in FIG. 10 as reference numerals 140 and 142.

Figure 11:
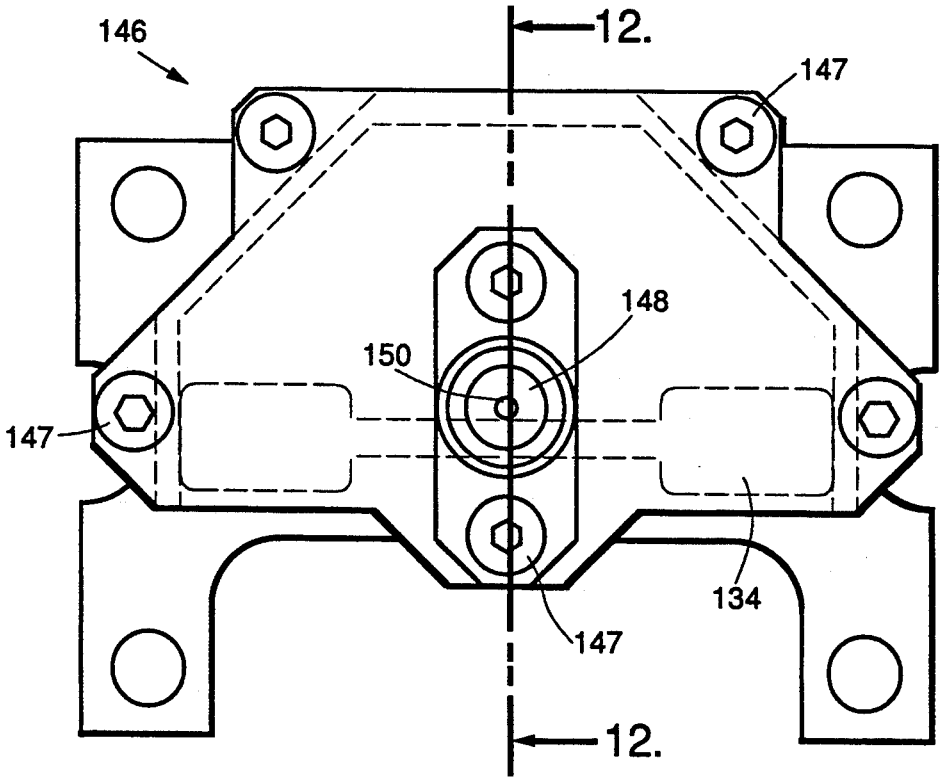
FIG. 11 is a plan view of a coax-to-waveguide adaptor for use with the switch shown in FIG. 10.
Figure 12:
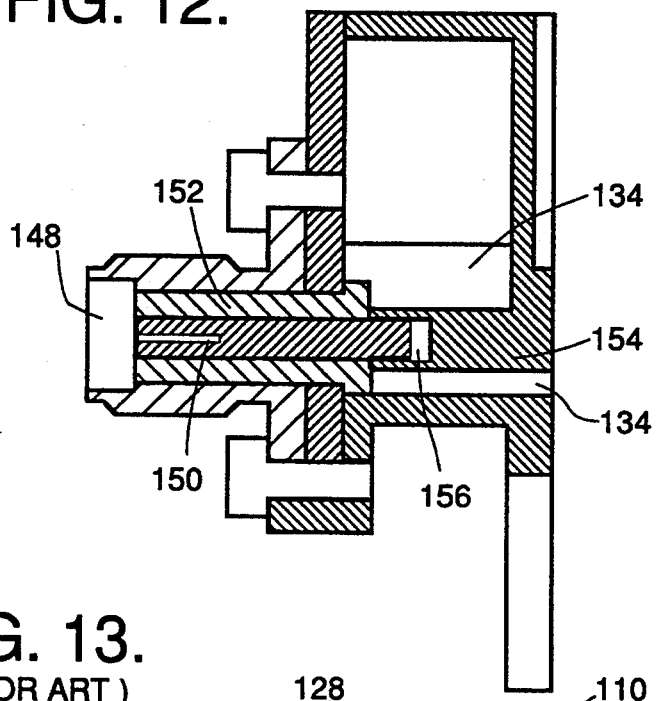
FIG. 12 is a cross-sectional view of the adaptor shown in FIG. 11 taken along line 12—12.

With additional reference to FIGS. 11 and 12, a coax-to-waveguide adaptor 146 is affixed to the stator 112 by means of the screws 147 or the like. In the preferred embodiment, the adaptor 146 can be affixed to the switch 110 at any one of the four waveguide ports of the stator 112. As shown in FIG. 10, more than one adaptor 146 can be affixed to the switch 110 at any time and the number of adapters 146 utilized depends on the application.

The coax-to-waveguide adaptor 146 includes a coax connector housing 148 which receives a coax connector (not specifically illustrated). The coax center conductor 150 receives the male end of the coax connector and is preferably enclosed within a Teflon sleeve 152. The center conductor 150 carries a coaxial transmission into the adaptor 146 and the sleeve 152 functions to maintain a 50 Ω coax impedance as the signal travels along the center pin to the ridge waveguide transition section 154. The center conductor 150 terminates at a passage 156 which is in fluid communication with waveguide path 134.

As best shown in FIG. 12, the center conductor 150 and the transition section 154 are parallel, or in-line, unlike the construction of the T-switch 10 previously described. As the coaxial transmission is radiated into the transition section 154 and the passage 156, the signal is transformed to a waveguide impedance of about 377 Ω. Thus, the transition section 154 functions as a single step-up coax-to-waveguide transformer.

Figure 13:
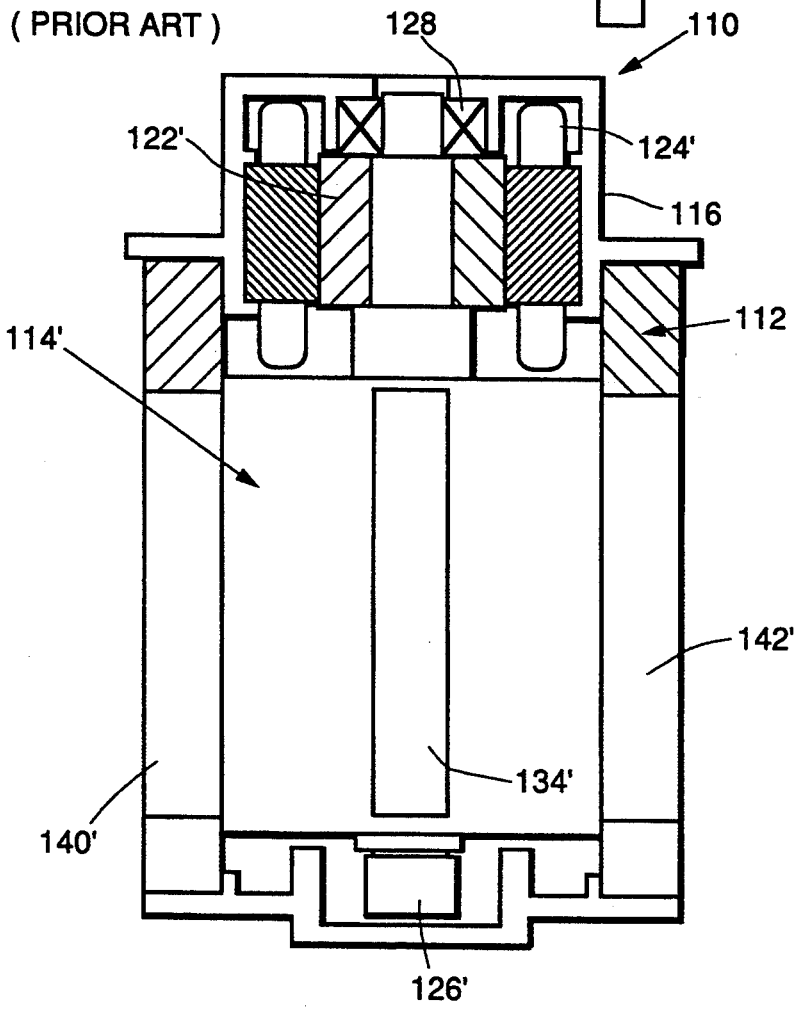
FIG. 13. ( PRIOR ART )
FIG. 13 is a cross-sectional view of a second embodiment of a prior art non-contacting waveguide "R" switch.

Referring now to FIG. 13, there is illustrated a second prior art non-contacting waveguide "R" switch, wherein like numbered elements are shown in FIG. 10, absent the "'". The switch 110' is preferably suitable for applications involving signals having a frequency approximately in the Ku band (i.e., 10–15 GHz). Since the switch 110' is useful for Ku band applications, the waveguide paths do not required a double-ridged construction. One or more coax-to-waveguide adaptors may be affixed to the switch 110', although the switch shown in FIG. 13 is shown without an adaptor.

Figure 14:
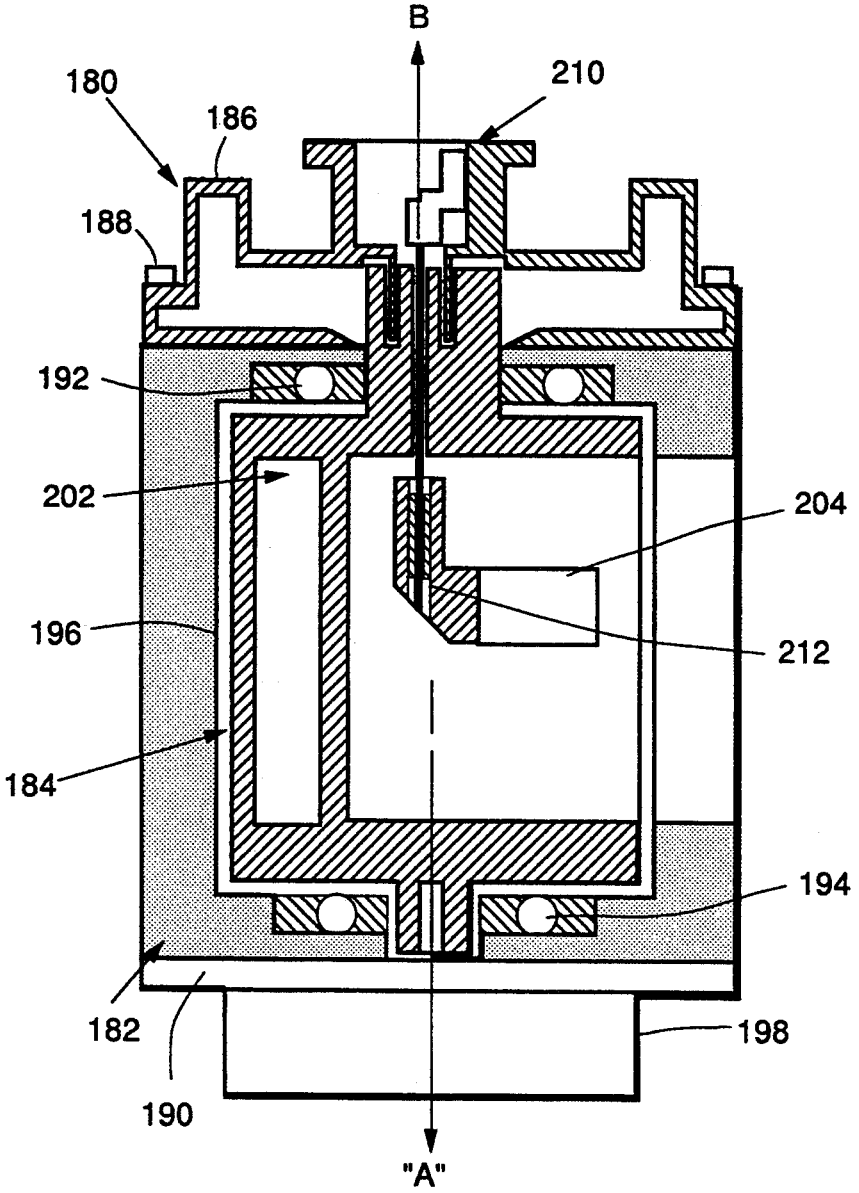
FIG. 14 is a cross-sectional view of a second embodiment of the non-contacting waveguide "T" switch of the present invention.

Referring now to FIG. 14, there is shown a second preferred embodiment of the non-contacting waveguide "T" switch shown generally by reference numeral 180. In this preferred embodiment, the waveguide switch 180 is a non-ridged waveguide switch suitable for applications involving signals having a frequency approximately in the Ku band (i.e., 10–15 GHz). Although the switch 180 is illustrated for use in applications involving the Ku band, similar switches for use with other frequency bands could be implemented. As illustrated, the switch 180 includes a housing, or stator, 182 and a rotor 184 disposed within the stator for rotation relative thereto. A top cover 186 is affixed to one end of the stator 182 by a plurality of screws 188 or the like and a bottom cover 190 is affixed to the opposite end of the stator.

As best shown in FIG. 14, bearings 192 and 194 are positioned between the stator 182 and the rotor 184 to allow the rotor to rotate relative to the stator. Preferably, the rotor 184 is sized such that an air gap 196 exists between the stator 182 and the rotor. An actuator, such as a motor 198, having a drive shaft 200, cooperates with the switch 180 such that the drive shaft extends into and engages the rotor 184 for rotation about an axis B relative to the stator 182.

As in the previous "T" switch embodiment, the stator 182 is preferably multi-faceted and includes a plurality of waveguide ports angularly spaced from each other by approximately 120° and extend from the perimeter of the stator inwardly to the air gap 196 generally orthogonal to the axis B. Because this switch is utilized with frequencies in the Ku band, the waveguide ports are non-ridged.

Figure 15:
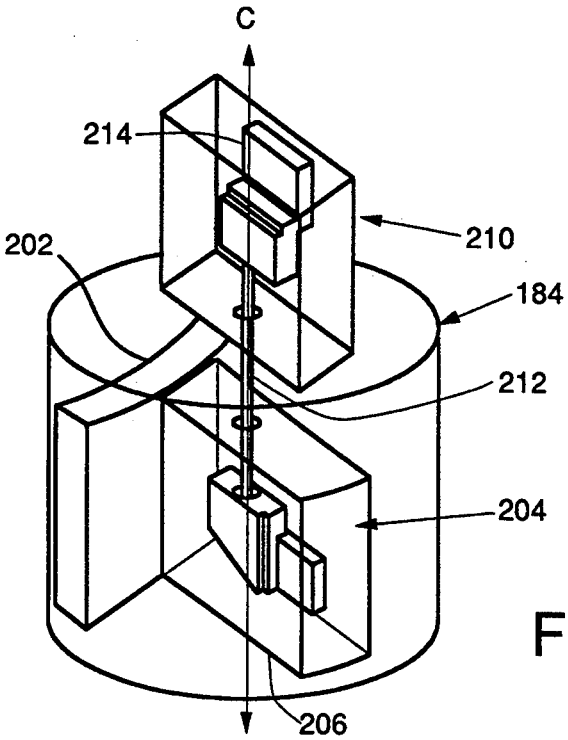
FIG. 15 is an isometric view of the rotor including a waveguide-to-coax transformer and a coax-to-waveguide transformer of the waveguide "T" switch shown in FIG. 14.

As best shown in FIG. 15, the rotor 184 is generally cylindrically shaped and includes a waveguide path 202 and a coax-to-waveguide adaptor 204. As illustrated, the waveguide path 202 is generally curved in shape and extends through the rotor 184 to form a pair of waveguide path ports at the rotor perimeter, only one of which is specifically illustrated. Preferably, the waveguide path 202 is also non-ridged, resulting in a generally rectangular-shaped waveguide path and associated path ports at the rotor perimeter. The path ports are angularly disposed about the circumference of the rotor 184 approximately 120° from each other, thereby allowing different pairs of the stator ports to be connected upon rotation of the rotor, as described in greater detail below.

Figure 16:
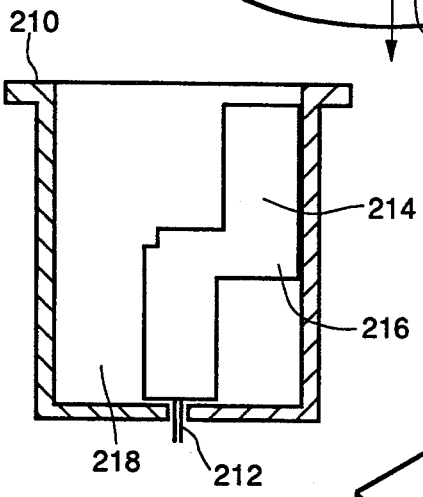
FIG. 16 is a partial cross-sectional view of the waveguide-to-coax transformer shown in FIG. 15.

As shown in FIGS. 15 and 16, unlike the C band "T" switch 10, which included a coax connector affixed to the top cover 16, the $K_u$ band "T" switch 180 utilizes a waveguide-to-coax adaptor 210 disposed within the stator 182. Preferably, a coax center conductor 212 extends from the waveguide-to-coax adaptor 210 to the coax-to-waveguide adaptor 204 (best shown in FIG. 17 and described in greater detail below). The coax conductor 212 is fixedly attached to the waveguide-to-coax adaptor 210.

As best shown in FIG. 16, the waveguide-to-coax adaptor 210 includes a two-step, or ¼-wave, waveguide-to-coax transformer 214. The transformer 214 is preferably made of aluminum and is affixed to the adaptor 210. Most preferably, adaptor 210 and transformer 214 comprise a single machined part and the transformer includes a transition section having a pair of 90° folds, or steps, 216 and 218. The construction of the waveguide-to-coax transformer 214 allows the incoming waveguide signal to be matched to the coax center conductor 212. Typically, the incoming waveguide signal has an impedance of about 377 Ω. The waveguide-to-coax transformer 214 functions to step-down the impedance of the signal to an impedance of about 50 Ω in two steps, allowing the signal to be carried by the coax conductor 212 to the coax-to-waveguide transformer 204. Preferably, the impedance of the signal is reduced by about 225 Ω at the first step 216 and by approximately 100 Ω at the second step 218.

Figure 17:
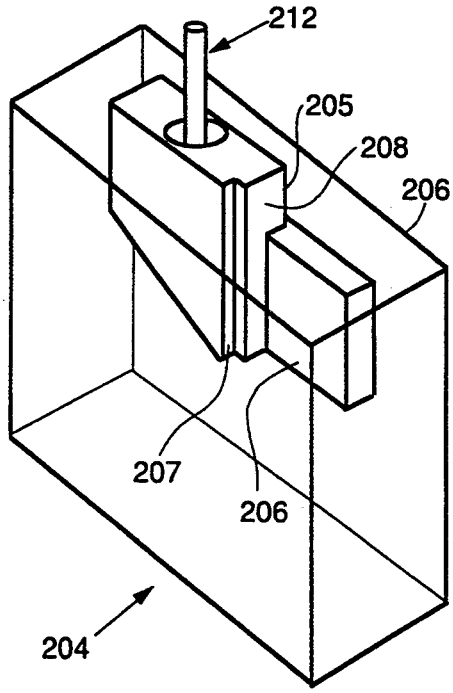
FIG. 17 is a perspective view of the coax-to-waveguide transformer shown in FIG. 15.

Referring now to FIGS. 15 and 17, the coax-to-waveguide adaptor 204 includes a coax-to-waveguide transformer 205, which has an axial bore sized to receive the coax center conductor 212 in a non-contacting fashion so as to create a coaxial port, or non-contacting capacitive sleeve, over the conductor. This construction allows for hot switching without a corresponding decrease in RF power. This non-contacting construction also forms a choke joint for the switch 180, which provides a virtual short at the interface of the center conductor 212 and the coax-to-waveguide transformer 204.

As shown in FIG. 17, in this preferred embodiment, the coax-to-waveguide transformer 205 is a two-step, or ¼-wave, coax-to-waveguide transformer. The transformer 205 is preferably made of aluminum and is affixed to the adaptor 204. Most preferably, adaptor 204 and transformer 205 comprise a single machined part and the transformer includes a transition section having a pair of 90° folds, or steps, shown generally by reference numerals 207 and 208. The construction of the coax-to-waveguide transformer 205 allows the incoming signal on the coax center conductor 212 to be impedance matched to the rectangular waveguide 206 of the adaptor. The signal being carried by the coax center conductor 212 is then transformed back to a waveguide signal by the coax-to-waveguide transformer 205. The transformer 205 includes a first 90° step 207 and second 90° step 208 so as to function as a two-step, step-up coax-to-waveguide transformer. Preferably, the first step 207 increases the impedance by about 100 Ω and the second step 208 increases the impedance of the signal by about 225 Ω to about 377 $\phi$, that of a typical waveguide signal.

As best shown in FIG. 15, the coax-to-waveguide adaptor 204 includes a generally rectangular-shaped waveguide 206 which extends radially outward from the rotor axis C terminating at the rotor perimeter to form a third rotor waveguide path port. Thus, when the generally curve-shaped waveguide path 202 is aligned with a pair of stator waveguide ports, the rectangular waveguide 206 is aligned with the third stator waveguide port.

The "T" switch 180 has a substantially similar switch state, switch state and port connection table as the table shown in FIG. 7 for the "T" switch 10. Additionally, the "T" switch 180 can be employed in a communication system such as that previously described and shown in FIG. 8 and is capable of redundancy switching to compensate for a failed circuit element, as previously described and shown in FIG. 9.

It is to be understood, of course, that while the forms of the invention described above constitute the preferred embodiments of the invention, the preceding description is not intended to illustrate all possible forms thereof. It is also to be understood that the words used are words of description, rather than limitation, and that various changes may be made without departing from the spirit and scope of the invention, which should be construed according to the following claims.

What is claimed is:

1. A waveguide switch comprising:

a stator having at least one waveguide port;

a coaxial conductor comprising a center conductor and a outer conductor for carrying a coaxial transmission, the coaxial conductor being affixed to the stator; and a rotor mounted for rotation relative to the stator, the rotor including at least one waveguide and at least one impedance matching transformer disposed in the at least one waveguide for receiving said coaxial center conductor and converting the coaxial transmission into a waveguide transmission, the transformer having a bore which forms a non-contacting sleeve about the coaxial conductor, the at least one waveguide carrying the waveguide transmission radiated from the transformer to the at least one waveguide port.

2. The waveguide switch of claim 1 wherein the center conductor is located on the axis of the rotor.

3. The waveguide switch of claim 1 wherein the impedance matching transformer includes at least one 90° step such that the waveguide transmission is radiated from the transformer in a direction generally orthogonal to the direction of the coaxial transmission.

4. The waveguide switch of claim 1 wherein the at least one waveguide is a double-ridged waveguide.

5. The waveguide switch of claim 1 wherein the waveguide transmission is a waveguide signal having a frequency range of about 3.6–4.2 GHz.

6. The waveguide switch of claim 1 wherein the waveguide transmission is a waveguide signal having a frequency range of about 10–15 GHz.

7. The waveguide switch of claim 1 wherein the stator has a plurality of double-ridged waveguide ports disposed approximately 120° from each other.

8. The waveguide switch of claim 7 wherein the rotor comprises a pair of double-ridged waveguides, one of the waveguides extending through the rotor to selectively connect two of the waveguide ports upon rotation of the rotor.

9. A waveguide switch comprising:

a stator having at least one waveguide port;

a coaxial conductor comprising a center conductor and a outer conductor for carrying a coaxial transmission, the coaxial conductor being affixed to the stator; and a rotor mounted for rotation relative to the stator, the rotor including a first waveguide and a single impedance matching transformer disposed in the waveguide for receiving said coaxial center conductor and converting the coaxial transmission into a waveguide transmission, the transformer having a bore which forms a non-contacting sleeve about the coaxial conductor, the first waveguide carrying the waveguide transmission radiated from the transformer to the at least one waveguide port.

10. The waveguide switch of claim 9 wherein the first waveguide is a double-ridged waveguide.

11. The waveguide switch of claim 9 wherein the impedance matching transformer includes at least one 90° step such that the waveguide transmission is radiated from the impedance matching transformer in a direction generally orthogonal to the direction of the coaxial transmission.

12. The waveguide switch of claim 9 wherein the waveguide transmission is a waveguide signal having a frequency range of about 3.6–4.2 GHz.

13. The waveguide switch of claim 9 wherein the center conductor is located on the axis of the rotor.

14. The waveguide switch of claim 9 wherein the first waveguide is generally orthogonal to the center conductor.

15. The waveguide switch of claim 9 wherein the stator has a plurality of waveguide ports disposed approximately 120° from each other.

16. The waveguide switch of claim 15 wherein the waveguide ports are double-ridged.

17. The waveguide switch of claim 16 wherein the rotor comprises a pair of double-ridged waveguides, one of the double-ridged waveguides extending through the rotor to selectively connect two of the waveguide ports upon rotation of the rotor.

18. A waveguide switch comprising:

a stator having at least two waveguide ports;

a first impedance matching transformer disposed within one of the at least two waveguide ports for converting a waveguide transmission into a coaxial transmission;

a coaxial conductor having a center conductor and a outer conductor, the outer conductor having a first end affixed to the first impedance matching transformer and a free end, the center conductor carrying the coaxial transmission; and a rotor mounted for rotation relative to the stator, the rotor including a first waveguide and a second impedance matching transformer disposed in the first waveguide for converting the coaxial transmission into a waveguide transmission, the second impedance matching transformer having a bore which forms a non-contacting sleeve about the free end of the center conductor, the first waveguide carrying the waveguide transmission radiated from the second impedance matching transformer to the other of the at least two waveguide ports.

19. The waveguide switch of claim 18 wherein the first waveguide is a non-ridged waveguide.

20. The waveguide switch of claim 19 wherein the first waveguide is generally orthogonal to the center conductor.

21. The waveguide switch of claim 18 wherein the first impedance matching transformer includes at least two 90° steps for matching the impedance of the associated waveguide port with the impedance of the coaxial conductor.

22. The waveguide switch of claim 18 wherein the second impedance matching transformer includes at least two 90° steps for matching the impedance of the coaxial conductor with the impedance of the associated waveguide port, the waveguide transmission being radiated from the second impedance matching transformer in a direction generally orthogonal to the direction of the coaxial transmission.

23. The waveguide switch of claim 18 wherein the waveguide transmission is a waveguide signal having a frequency range of about 10–15 GHz.

24. The waveguide switch of claim 18 wherein the center conductor is located on the axis of the rotor.

25. The waveguide switch of claim 18 wherein the at least two waveguide ports are non-ridged.

26. The waveguide switch of claim 18 wherein the stator has three waveguide ports circumferentially disposed thereabout approximately 120° from each other.

27. The waveguide switch of claim 26 wherein the rotor further comprises a second waveguide, the second waveguide being non-ridged and extending through the rotor to selectively connect two of the circumferentially disposed waveguide ports upon rotation of the rotor.

* * * * *